US005169048A

United States Patent [19]

Himebaugh

[11] Patent Number: 5,169,048

[45] Date of Patent: Dec. 8, 1992

[54] SHINGLING APPARATUS

[76] Inventor: Forrest K. Himebaugh, 300 Parkway, Box 253, Lake George, Mich. 48633

[21] Appl. No.: 831,686

[22] Filed: Feb. 5, 1992

[51] Int. Cl.[5] ..... B27F 7/00

[52] U.S. Cl. ..... 227/111

[58] Field of Search ..... 227/110, 111, 100, 101; 52/747, 748

[56] References Cited

U.S. PATENT DOCUMENTS

| | | | |
|---|---|---|---|
| 463,106 | 11/1891 | Dees | 227/111 |
| 3,007,838 | 11/1961 | Eigenmann . | |
| 3,173,593 | 3/1965 | Elliott | 227/111 |
| 3,298,584 | 1/1967 | Miller | 227/111 X |
| 3,794,237 | 2/1974 | Hernandez | 227/111 |
| 3,972,462 | 8/1976 | Evans et al. | 227/111 |
| 3,982,711 | 9/1976 | Bradley et al. | 242/86.52 |
| 4,265,387 | 5/1981 | Strouse | 227/111 X |
| 4,460,433 | 7/1984 | Boyd | 156/574 |
| 4,869,044 | 9/1989 | Wald | 52/746 |
| 4,890,801 | 1/1990 | Brouwer et al. | 242/568 |
| 5,081,815 | 1/1992 | Carnell | 227/110 X |

*Primary Examiner*—Douglas D. Watts
*Assistant Examiner*—Rinaldi Rada
*Attorney, Agent, or Firm*—Learman & McCulloch

[57] ABSTRACT

Shingling apparatus for applying strips of shingling material in successive courses to a roof comprises a frame having a motorized drive belt assembly mounted thereon. A roll of the shingling strip material is carried on the frame and fed to a position atop the roof and beneath the belt assembly. Driving of the belt assembly unwinds the shingling material from the roll and deposits it on the roof. A series of actuators is mounted on the drive belt for movement therewith for periodically actuating a pneumatic nailer carried by the frame to fasten the shingling material to the roof in timed relation to the movement of apparatus.

18 Claims, 2 Drawing Sheets

FIG - 1
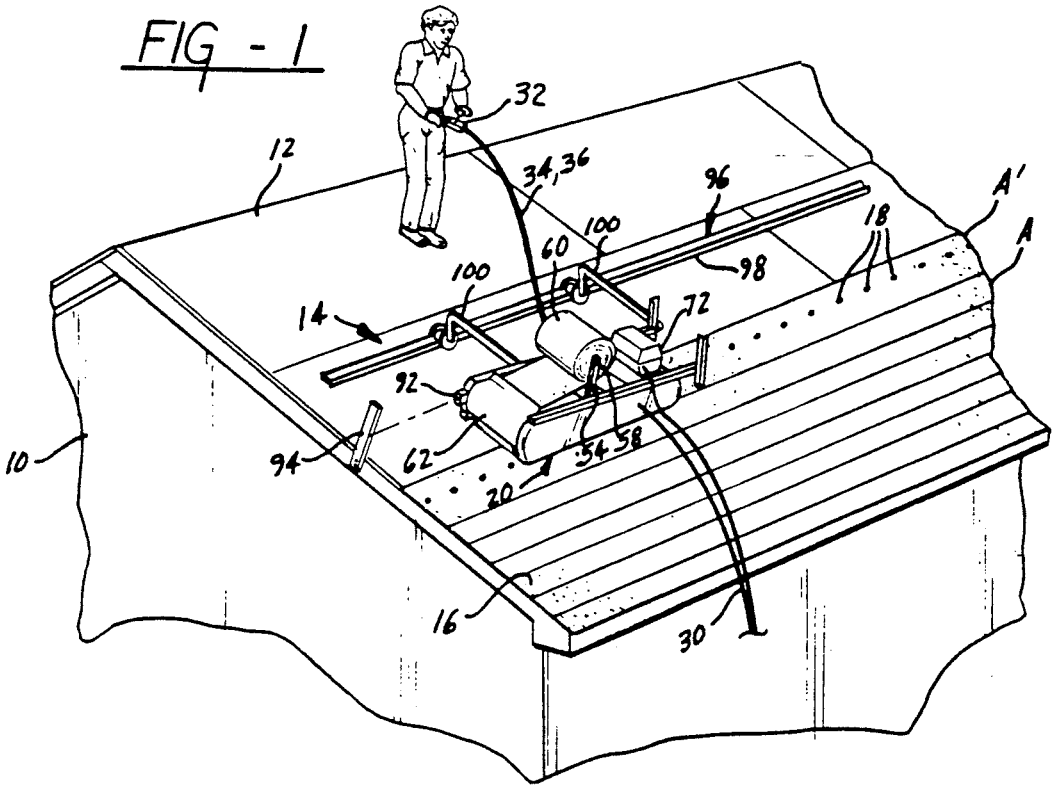
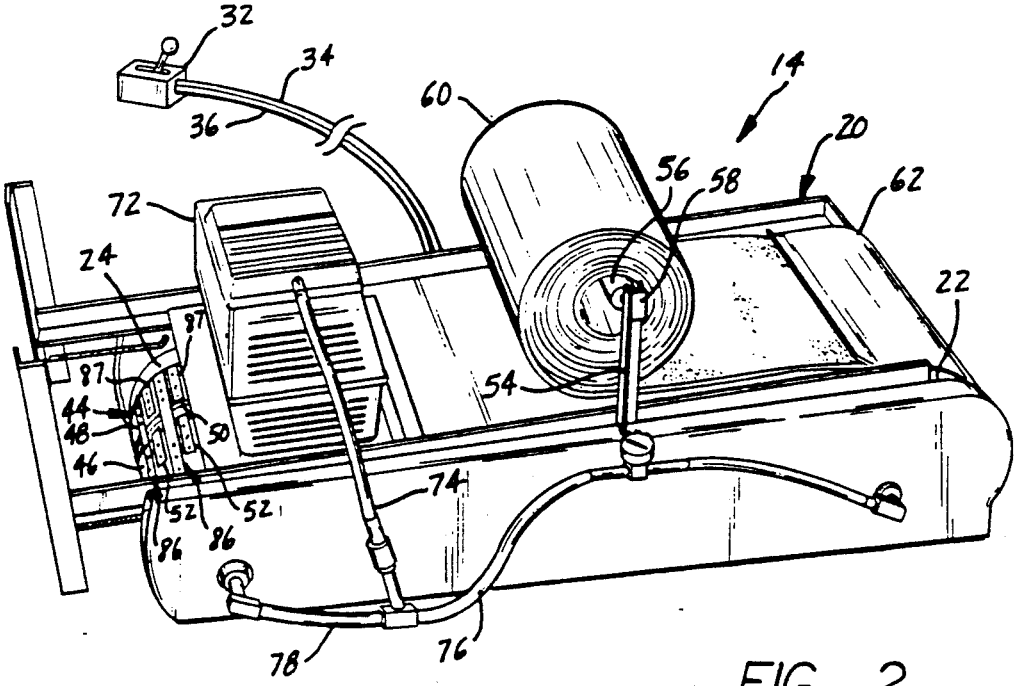
FIG - 2

SHINGLING APPARATUS

This invention relates to apparatus for applying strips of shingling material to a subsurface, such as a roof of a building.

BACKGROUND OF THE INVENTION

Pitched roofs of buildings normally are provided with partially overlapping courses of shingles for protecting the buildings against inclement weather. The conventional method for applying these shingles is to position the shingles manually on the roof and nail or staple them in place. This process typically involves several installers and is very time consuming. As a result, even a simple roofing project usually is quite costly.

In addition to the time and cost involved, the installers sometimes are required to stand or kneel on the newly laid shingles when installing successive courses of shingles. This unnecessarily subjects the shingles to potential damage.

SUMMARY OF THE INVENTION

The invention comprises a shingling apparatus for applying strips of shingling material to a subsurface, such as a roof. The apparatus comprises mobile frame means, means for supporting a supply of the shingling material on the frame means, means for an imparting movement to the frame means, means responsive to the movement of the frame means for depositing shingling material in place on the subsurface, and securing means mounted on the frame means for periodically driving nails or staples through the deposited shingling material in timed relation to the movement of the frame means to secure the shingles to the subsurface.

One advantage of the invention is that it obviates much of the manual labor associated with the prior art roofing processes. A machine constructed according to the invention automatically applies the shingles to the roof and secures them to the roof. When employing the apparatus of the invention, one person can shingle a roof in about one-fifth the time it might take two or more workers to shingle the same roof manually. Consequently, the invention provides a tremendous savings in time, labor, and cost.

Another advantage of the invention is its ability to obtain a superior quality finished product. When using the shingling apparatus of the invention, successive courses of shingles are straighter and more uniform than manually applied shingles. Additionally, the shingling material is uniformly fastened to the roof.

Still another advantage of the invention is that a roof can be shingled without requiring installers to stand, kneel, or walk on the newly laid shingles, unlike the manual process. Thus, apparatus according to the invention makes possible reduction in damage to the shingles by the installer.

THE DRAWINGS

FIG. 1 is a fragmentary perspective view of shingling apparatus constructed according to the invention in the process of applying successive courses of shingles to a roof;

FIG. 2 is an isometric view of the shingling apparatus;

DETAILED DESCRIPTION

Figure 3:
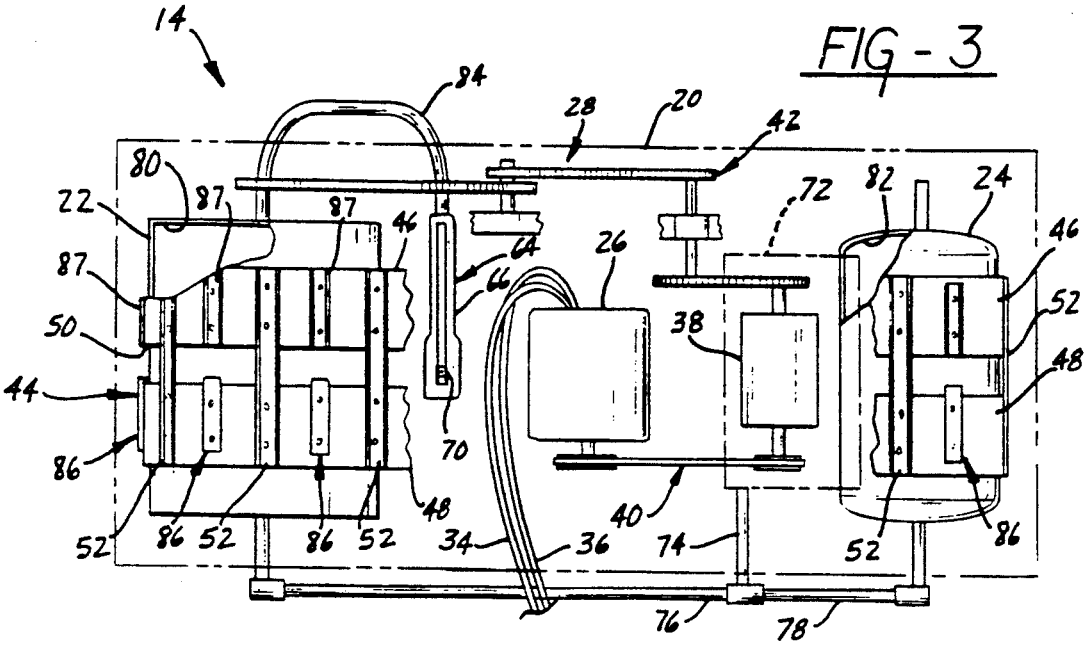
FIG. 3 is a fragmentary bottom view of the apparatus.
Figure 4:
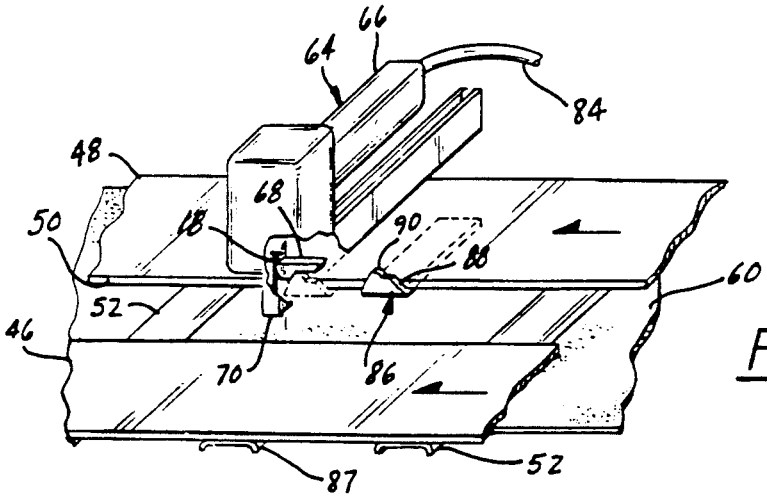
FIG. 4 is a fragmentary, isometric view showing the interaction between a tracking assembly and a nailer.

FIG. 1 shows a building 10 having a roof 12 which is being shingled by shingling apparatus 14 constructed in accordance with the invention. The shingles, generally denoted at 16, are applied in partially overlapping courses, with the two most recently applied courses denoted A and A', respectively. Each course comprises a strip 16 of shingling material which may take the form of a series of individual three-in-one type shingles or, preferably, a coiled web of the shingling material. The shingling material may be fabricated of conventional roofing material, such as asphalt or fiberglass and preferably has a width of about twelve inches.

Each course of shingles is secured to the underlying roof 12 by a plurality of uniformly spaced securing means, such as staples or roofing nails 18. Each row of roofing nails 18 is covered and concealed by the overlapping portion of the next successive course of shingles, as is conventional.

The shingling apparatus 14 includes a frame 20 on which are rotatably mounted forward and rearward wheels or drums 22, 24, respectively. An electric motor 26 is mounted on the frame 20 and is operatively coupled to the rear drum 24 through gearing mechanism 28. The electric motor 26 has electric supply lines 30 for connection to a remote power supply (not shown). The electric motor 26 is preferably a two speed, reversible motor remotely controlled by a hand held controller 32 electrically connected to the motor 26 by a pair of electrical control wires 34, 36 dedicated to the high/low speed and forward/reverse control of the motor 26.

The gearing mechanism 28 includes a gear reducer 38 mounted on the frame 20 and coupled to the motor 26 by a belt and pulley assembly 40. The reducer 38 is coupled to the rear drum 24 by a sprocket and chain assembly 42. Energizing the motor 26 imparts rotation to the rear drum 24 in either a forward or reverse direction and at a high or low speed, depending upon the control selection.

The forward and rearward drums 22, 24 support a combined drive and shingle laying assembly 44. The assembly 44 comprises a pair of endless belts 46, 48 which are supported side-by-side on the drums 22, 24 in spaced apart relationship and separated by a gap 50. A plurality of cleats 52 is mounted on the belts 46, 48 to provide traction thereto. The cleats 52 comprise generally U-shaped, elongated stamped metal members which are arranged transversely of the belts 46, 48 and span the gap 50 to interconnect the belts 46, 48 at uniformly spaced intervals. Rotation of the rear drum 24 by the motor 26 causes the belts to move in unison with rotation of the drum 24 to impart linear forward or reverse motion to the apparatus 14.

Extending upwardly from the frame 20 is a pair of uprights 54. A support rod 56 extends between the uprights 54 and has its ends removably accommodated in a corresponding pair of sockets 58 at the upper ends of the uprights 54. The support rod 56, in turn, supports a coiled strip 60 of the shingling material which is freely rotatable on the rod 56 in a direction to unwind the strip from the roll. The unrolled strip passes around one or the other ends of the frame 20 and under the assembly 44 for engagement from above with the belts 46, 48 and from below with the roof 12. A guide 62 may be mounted at one or both ends of the frame 20 for guiding the strip of shingling material around the end of the frame.

Figure 5:
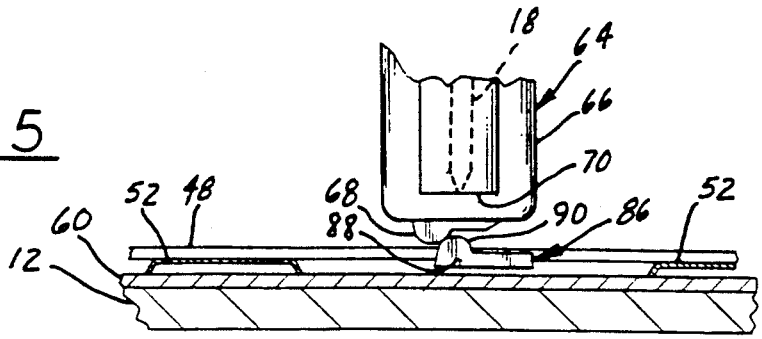
FIG. 5 is a fragmentary side view, partly in section, showing an actuator on the tracking assembly interacting with a trigger on the nailer.

Shingle securing means 64 is mounted on the frame 20 for periodically nailing or stapling the laid-down strip of shingling material to the roofing subsurface 12 in timed relation to the movement of the apparatus 14 along the roof 12. The securing means 64 comprises a pneumatic nail gun 66 having a trigger 68 (FIG. 5) which, when actuated, delivers a nail 18 through an opening 70 in the nail gun 66 and drives it through the shingle into the substructure. The preferred nailing gun 66 is a coil roofing nailer, Model N-12B-1 manufactured and sold by Stanley Bostitch, Inc. If staples are preferred, Bostitch roofing stapler Model T-35 is acceptable. The nail gun 66 is resiliently mounted on the frame 20 and so positioned that the opening 70 is between the belts 46, 48 of the track assembly 44. Thus, when the nail gun is actuated, the nails 18 pass through the gap 50.

An electrically operated air compressor 72 is carried on the frame 20 for producing compressed air for the pneumatic nail gun 66. The air compressor 72 has a compressed air supply line 74 which is coupled to each of the drums 22, 24 through lines 76 and 78, respectively. Each of the drums 22, 24 includes air chambers 80, 82 therein which act as storage tanks for the compressed air. The rear chamber 82 is coupled to the pneumatic nail gun 66 through an air line 84.

The assembly 44 has mounted thereon a plurality of actuators 86 which periodically actuate the trigger 68 of the nail gun 66. Each of the actuators 86 comprises a metal bar coupled to one of the belts 46 or 48 and having an actuating cam 88 projecting into the gap 50 between the belts 46, 48. The cam 88 has a lobe 90 for engaging the trigger 68 of the nail gun 66. The actuators 86 are evenly spaced along the outer periphery of one of the belts 46 or 48 with a spacing corresponding to the desired spacing of the nails 18 to be applied to the deposited strip of shingling material, as shown in FIG. 1. The preferred spacing is approximately one foot.

Opposite each actuator 86 is a short cleat 87 which is identical to the cleats 52, except for length, and is attached to only one of the belts.

In operation, the shingling apparatus 14 is positioned atop of and at one of the side edges of the roof 12. The roll 60 of shingling material is mounted on the frame 20 with the free end of the roll 60 properly oriented with respect to the direction of travel. The free end of the strip is manually unwound from the roll 60, wrapped around the leading end of the apparatus 14 and sandwiched between the assembly 44 and the roof so that the apparatus 14 rests on a section of the shingling material. The motor 26 then may be energized to drive the assembly 44 and propel the apparatus 14 along the roof toward its opposite side.

As the belts of the assembly 44 are driven, strip material from the roll 60 is unwound and laid down in position on the roof. As the assembly belts move, the actuators 86 pass by and periodically engage the trigger 68 of the nail gun 66. As each actuator 86 engages the trigger 68, a nail 18 (shown in phantom in FIG. 3) is ejected from the gun and driven downwardly through the gap 50 between the belts 46, 48 and through the laid-down shingling material into the roof substructure to secure the shingling material to the roof. This continuous laying and nailing of the strip continues until the apparatus 14 reaches the end of the course.

In order to prevent the apparatus 14 from propelling itself off the edge of the roof, an automatic shut-off mechanism 92 is provided. This mechanism comprises a shut-off switch mounted at each end of the frame 20 (only one of which is shown in FIG. 1) for engaging a stop 94 fastened to the side of the roof 12. When the switch 92 engages the stop 94, it is automatically tripped and shuts off the power supply to the motor 26.

When shingling most roofs, the drive assembly 44 itself will be able to guide the apparatus 14 along a straight path when laying the shingling material. However, if the pitch of the roof 12 is very steep, or the surface uneven, it may be desirable to employ a guide mechanism 96 like that shown in FIG. 1 in order to keep the apparatus tracking properly. The guide mechanism 96 comprises a linear U- or L-shaped channel 98 fastened to the roof at a position above the course of shingles to be laid and parallel to the path of travel to be followed by the shingling apparatus 14. Extending from the frame 20 is a pair of arms 100 each of which terminates at its free end in a rotatable wheel which is accommodated in the channel 98 and guides the apparatus 14 along a straight path.

Following completion of the securing of a course of shingles to the roof, the apparatus 14 is stopped, the laid-down shingles severed from the remainder of the roll, and the roll repositioned on the apparatus 14 so that the unwound strip extends around and under the opposite end of the frame. The apparatus is moved upwardly of the roof approximately 5 ¼ inches to enable a second course to overlap the previous course. The motor 26 is driven in the opposite direction to drive the apparatus 14 parallel to the previous course, but in the opposite direction. If the guide mechanism 96 is employed, it also will need to be advanced upwardly at the same 5 ¼ inches increment for each successive course of shingles.

The disclosed embodiment is representative of the presently preferred form of the invention, but is intended to be illustrative rather than definitive thereof. The invention is defined in the claims.

I claim:

1. Shingling apparatus for applying a course of shingling material to a subsurface, said apparatus comprising a frame; means for supporting a supply of shingling material on said frame; means for imparting movement to said frame; an endless track assembly movably supported on said frame and responsive to the movement of said frame for depositing the shingling material on the subsurface; and securing means carried by said frame for movement with said frame and operable in response to the movement of said frame to secure the deposited shingling material to said subsurface.

2. Apparatus as set forth in claim 1 wherein said track assembly is supported on and spans a pair of drums rotatably mounted on said frame.

3. Apparatus as set forth in claim 2 wherein said track assembly includes actuating means movable therewith for periodically engaging and actuating said securing means.

4. Apparatus as set forth in claim 3 wherein said actuating means comprises a plurality of uniformly spaced members mounted on said assembly.

5. Apparatus as set forth in claim 3 wherein said assembly includes cleats for furnishing traction to said apparatus.

6. Apparatus as set forth in claim 5 wherein said assembly comprises a pair of endless belts supported side-by-side on said drums and separated by a gap.

7. Apparatus as set forth in claim 6 wherein said actuating means projects into said gap for engagement with said securing means.

8. Apparatus as set forth in claim 7 wherein said securing means delivers fasteners through said gap.

9. Apparatus as set forth in claim 6 wherein said cleats bridge said gap and interconnect said belts.

10. Apparatus as set forth in claim 2 wherein said movement imparting means comprises a motor operatively connected to at least one of said drums for imparting rotation thereto.

11. Apparatus as set forth in claim 10 wherein said motor comprises a multiple-speed, reversible motor.

12. Apparatus as set forth in claim 10 including means for automatically stopping the movement of said apparatus at selected locations along a path of travel of the apparatus.

13. Apparatus as set forth in claim 1 wherein said securing means comprises a pneumatic nailer.

14. Apparatus as set forth in claim 13 including an air compressor operatively connected to said nailer for supplying pressurized air thereto.

15. Apparatus as set forth in claim 14 wherein said track assembly comprises an endless belt supported on and spanning a pair of drums rotatably mounted on said frame, at least one of said drums having a chamber therein operatively connected to said air compressor and said nailer for containing a supply of pressurized air.

16. Apparatus as set forth in claim 15 wherein both of said drums are provided with an air chamber.

17. Apparatus as set forth in claim 1 including guide means for guiding said apparatus along a linear travel path.

18. Apparatus as set forth in claim 17 wherein said guide means includes a linear guide channel attachable to the subsurface and means carried by said frame for movably engaging and coupling said frame with said linear guide track.

* * * * *